United States Patent [19]

Paquet

[11] 4,408,460

[45] Oct. 11, 1983

[54] HEATING SYSTEM FOR A STEAM TURBINE ENERGY PRODUCING PLANT

[75] Inventor: André J. Paquet, Brussels, Belgium

[73] Assignee: Hamon-Sobelco, S.A., Brussels, Belgium

[21] Appl. No.: 199,193

[22] Filed: Oct. 21, 1980

[30] Foreign Application Priority Data

Jan. 18, 1980 [EP] European Pat. Off. ..... 80400077.6

[51] Int. Cl.[3] ..... F01K 7/34

[52] U.S. Cl. ..... 60/678; 60/660

[58] Field of Search ..... 60/654, 678, 692, 693, 60/660, 677; 55/400, 406

[56] References Cited

U.S. PATENT DOCUMENTS

| | | | |
|---|---|---|---|
| 2,900,793 | 8/1959 | Buri | 60/678 X |
| 2,921,441 | 1/1960 | Buri | 122/1 C |
| 3,785,128 | 1/1974 | Redemann | 55/406 X |

*Primary Examiner*—Allen M. Ostrager
*Assistant Examiner*—Stephen F. Husar
*Attorney, Agent, or Firm*—Kerkam, Stowell, Kondracki & Clarke

[57] ABSTRACT

The system comprises a series of heaters arranged in cascade and fed with steam from drawoffs at pressures which progressively decrease from the steam boiler side to the condenser side of the plant.

In order to improve the efficiency of the plant with which the system is associated, the system comprises a plurality of biphase turbines arranged in cascade. The first of the turbines is fed from the drain of the heater at the highest pressure and the following turbines are each fed at least in part with the outlet liquid of the biphase turbine preceding it. These biphase turbines produce mechanical energy by recovery of the kinetic energy of the condensates of the heaters feeding them.

8 Claims, 4 Drawing Figures

SU
TB11
V11
V'11
RN11
R16
S16
TB12
V12
V'12
R15
S15
RN12
SR15
SE
DRT
PA
V13
V'13
TB13
RN13
RN14
R14
S14
V15
A
PR
V14
R13
S13
V16
RN15
SR16
CP
TB14
V17
V'14
RN16
R12
S12
V18
V'15
TB15
R11
S11
SOR
P10
PE

HEATING SYSTEM FOR A STEAM TURBINE ENERGY PRODUCING PLANT

DESCRIPTION

1. Technical Field

The present invention relates to systems for heating condensed water employed in steam turbine energy producing plants such as electric power stations.

2. Background of the Prior Art

Heating systems for condensed water from steam turbines usually comprise a number of heaters disposed between the condenser and the steam boiler of the plant for heating the water condensed in the condenser. The heaters are fed with steam at different pressures from respective drawoffs on the turbine. Between certain heaters and the immediately adjacent heater fed with steam from a drawoff at a lower pressure, there is disposed a phase separator receiving the water-steam mixture from the blowoff of the heater associated with the drawoff at higher pressure and feeding the heater associated with the drawoff at a lower pressure, in parallel with this drawoff at lower pressure, with steam separated from said mixture in the phase separator device. Further, in nuclear pressurized water power stations, there is provided a superheater whose condensates are sent to the heater associated with the drawoff at the highest pressure through a phase separator.

With this arrangement, a part of the energy of the water-steam mixture of the blowoff of certain of the condensation exchangers, superheaters or heaters, are employed for contributing to the heating of the fluid of the condenser-turbine circuit in a condensation exchanger fed with the steam at a lower pressure. However, a part of this energy is lost in the form of heat in the main regulating valve provided in the blowoff pipe up-stream of the phase separator and in the phase separator.

BRIEF SUMMARY OF THE INVENTION

An object of the invention is to provide a heating system which enables a part of the energy lost in heating systems of the prior art to be used, so as to increase the overall energy efficiency of the energy producing plant with which the heating system is associated.

Another object of the invention is to provide a heating system for a steam turbine energy producing plant which, while it has an improved efficiency relative to the heating systems of the prior art, is simpler in construction than the latter.

A further object of the invention is to provide a heating system for a steam turbine energy producing plant, which reduces erosion encountered in conventional heating systems due to the high speed of the water-steam mixture at the outlet of the main regulating valve.

The invention such as defined in the claims enables these objects to be attained through the use of a biphase turbine which eliminates the need for the main regulating valve and phase separator of prior art system.

BRIEF DESCRIPTION OF THE DRAWINGS

Further features and advantages of the invention will be apparent from the ensuing description of two particular embodiments thereof illustrated in the accompanying drawings in which.

DETAILED DESCRIPTION OF THE INVENTION

Figure 1:
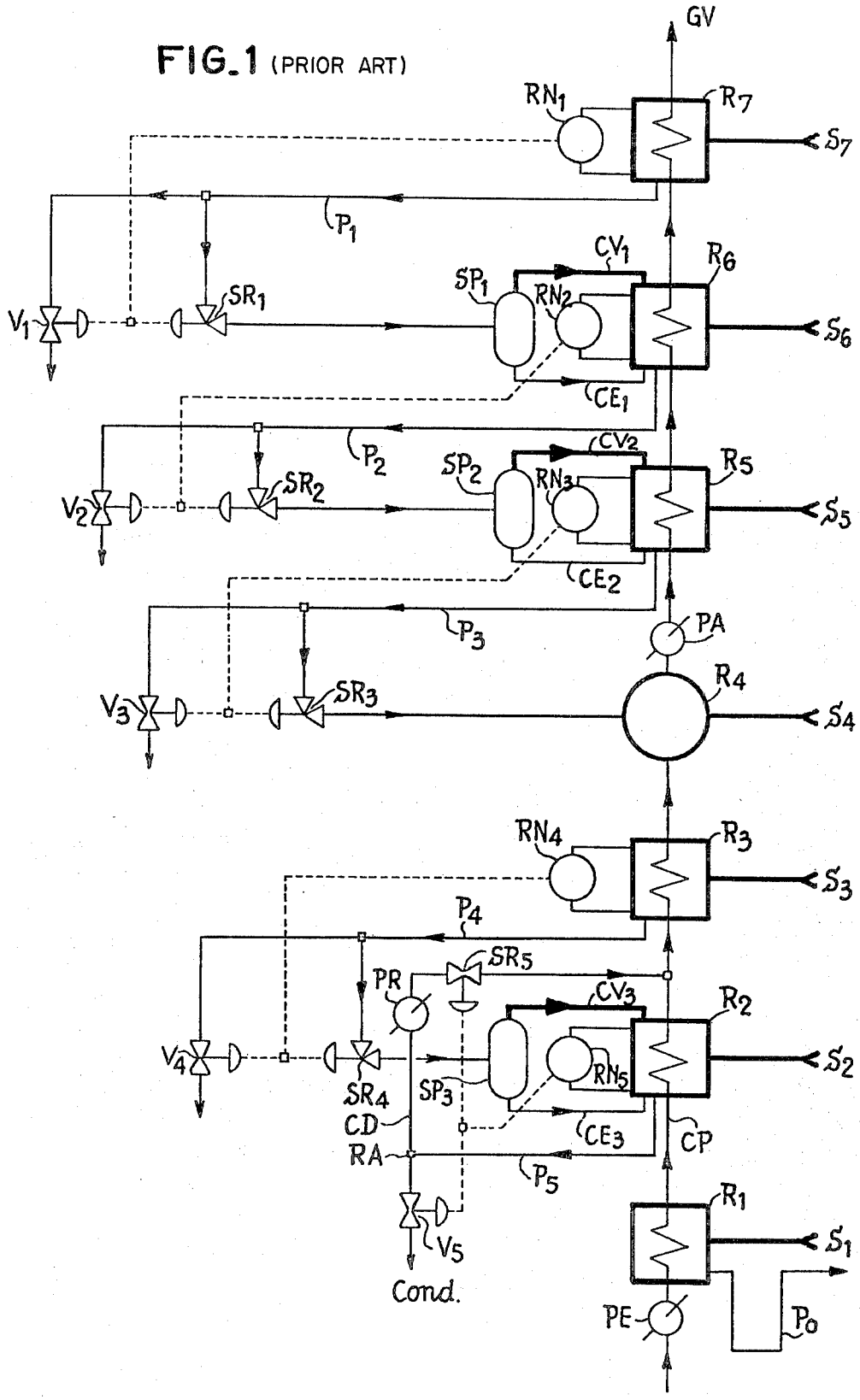
FIG. 1 (PRIOR ART)
FIG. 1 is a diagram of a conventional heating system for an electric power station employing fossil fuel.

With reference to FIG. 1, there is shown the diagram of a conventional heating system having seven heaters $R_1$,$R_2$,$R_3$,$R_4$,$R_5$,$R_6$ and $R_7$. The heaters $R_1$ to $R_7$ heat the condensed water drawn off by an extracting pump PE from the condenser (not shown) of the steam turbine electric power station employing fossil fuel with which the heating system is associated.

The heater $R_1$ is fed with steam from a drawoff $S_1$ at 0.3 bar and at a rate of flow representing 4.5% of the total flow (100% by weight) delivered by the heater $R_7$ to the steam boiler (not shown) of the plant. The steam condensed in the heater $R_1$ is sent through a drain pipe $P_o$ to the condenser. The second heater $R_2$ connected in series in the main condensed water circuit CP downstream of the heater $R_1$ is fed with steam from the drawoff $S_2$ at a pressure of 1 bar at a flow of 4.5% by weight. Third heater $R_3$ disposed downstream of the heater $R_2$ in the circuit CP, is fed with steam from a drawoff $S_3$ at a pressure of 2 bars at a flow representing 3% by weight of the total flow.

The flow of the main circuit CP at the outlet of the heater $R_3$ which represents 75% by weight of the total flow at the outlet of the heater $R_7$ is sent to a mixing heater or degassing tank $R_4$ which is fed with steam from a drawoff $S_4$ at a pressure of 4 bars and a flow representing 3.5% by weight of the total flow. Water from the heater $R_3$ and steam from the drawoff $S_4$ are mixed in the mixing heater $R_4$ and this mixture is drawn off by a feed pump PA which sends it to the heater $R_5$ which is fed with steam from a drawoff $S_5$ at a pressure of 9 bars and at a flow representing 7% by weight of the total flow. The water issuing from the heater $R_5$ is then sent to a heater $R_6$ which is fed with steam from a drawoff $S_6$ at a pressure of 18 bars and at a flow representing 7% by weight of the total flow.

The water issuing from the heater $R_6$ is again heated in the last heater $R_7$ which is fed with steam from a drawoff $S_7$ at a pressure of 36 bars and a flow representing 7.5% by weight of the total flow. The condensed water issuing from the heater $R_7$ therefore represents, as mentioned before, 100% of the total flow which is sent under a pressure of the order of 200 to 220 bars to the steam boiler GV (not shown) of the plant where this water is converted into steam so as to be sent back to the turbine (not shown).

The steam issuing from the drawoff $S_7$ is condensed in the heater $R_7$ and the condensates of this steam thus formed are discharged from the heater $R_7$ by way of a drain pipe $P_1$ connected to a first phase separator $SP_1$ through a main regulating valve $SR_1$. A motorized safety regulating valve $V_1$ is by-pass connected, relative to the main regulating valve $SR_1$, to the drain pipe $P_1$ so as to return if necessary the condensates of the drain pipe $P_1$ directly to the condenser. The regulating valves $SR_1$ and $V_1$ are controlled by a level regulator $RN_1$ which is adapted to regulate the level of water in the heater $R_7$. The mixture at 244° C. of the drain pipe $P_1$ is sent through the main regulating valve $SR_1$ into the phase separator $SP_1$ which separates the water from the steam resulting from the expansion, the steam being sent by way of a pipe $CV_1$ on the steam side to the heater $R_6$ and the water being sent by way of the pipe $CE_1$ on the water side to the heater $R_6$.

The condensates received in the heater $R_6$ are sent by way of a drain pipe $P_2$ to a phase separator $SP_2$ through a main regulating valve $SR_2$ with which there is connected in parallel a motorized safety regulating valve $V_2$. The condensates at 207° C. of the drain pipe $P_2$ are separated in the phase separator $SP_2$ and the steam is sent by way of a pipe $CV_2$ to the steam side of the heater $R_5$, whereas the water is sent by way of a pipe $CE_2$ to the water side of the heater $R_5$. The phase separator $SP_2$ and the regulating valves $SR_2$ and $V_2$ which are controlled by a level regulator $RN_2$ which regulates the water level in the heater $R_6$, operate in the same manner and perform the same function as the phase separator $SP_1$ and the regulating valves $SR_1$ and $V_1$ described hereinbefore.

The condensates at 175° C. received in the heater $R_4$ are sent by way of a drain pipe $P_3$ to the mixing heater $R_4$ through a main regulating valve $SR_3$ with which a motorized safety regulating valve $V_3$ is by-pass connected. The valves $SR_3$ and $V_3$ are controlled by a level regulator $RN_3$ which regulates the level of condensates in the heater $R_5$. The mixture flowing in the drain pipe $P_3$, which represents 21.5% by weight of the total flow, is mixed in the degasing tank $R_4$ with the water coming from the heater $R_3$ and the steam from the drawoff $S_4$ so that the feed pump PA has a flow representing 100% of the total flow.

The condensates received in the heater $R_3$ are sent by way of a drain pipe $P_4$ to a phase separator $SP_3$ through a main regulating valve $SR_4$ with which there is by-pass connected a motorized safety regulating valve $V_4$ which, as the valves $V_1$, $V_2$ and $V_3$ sends the condensates directly to the condenser in the event of an incident. The regulating valves $SR_4$ and $V_4$ are controlled by a level regulator $RN_4$ which regulates the water level in the heater $R_3$. The condensates at 120° C. of the drain pipe $P_4$ are divided in the phase separator $SP_3$ from which the steam is sent to the steam side of the heater $R_2$ by way of a pipe $CV_3$ whereas the water is sent to the water side of the heater $R_2$ by way of a pipe $CE_3$.

The drain pipe $P_5$ which receives the condensates at 100° C. issuing from the heater $R_2$ is connected at RA to a by-pass pipe CD which is connected between, on one hand, the condenser and, on the other hand, the main pipe CP, between the heaters $R_2$ and $R_3$. A motorized safety valve $V_5$ is disposed in the by-pass pipe CD between the connection RA and the condenser, and a main regulating valve $SR_5$ is disposed in the pipe CD between the connection RA and the connection of the pipe CD with the main pipe CP. The regulating valves $SR_5$ and $V_5$ are controlled by a level regulator $RN_5$ which regulates the water level in the heater $R_2$. A pump PR for receiving the condensates is disposed in the pipe CD between the connection RA and the regulating valve $SR_5$ so as to re-inject the condensates of the drain pipe $P_5$ into the main pipe CP. In the event the pump PR fails, the condensates are returned to the condenser by way of the safety regulating valve $V_5$.

In operation, a part of the heat energy of the mixture issuing from the heaters $R_7$, $R_6$, $R_5$, $R_3$ and $R_2$ is used for heating the water of the main circuit, either by direct re-injection into the latter from the heaters $R_5$ and $R_2$, or by sending it to the following heater after separation of the liquid phase and the steam phase in the phase separators $SP_1$, $SP_2$ and $SP_3$. However, a part of the energy of this mixture, present in the form of pressure, is lost in the phase separators which, moreover, have the drawback of being subject to a high degree of erosion owing to the high speed of the mixture at the outlet of the regulating valves.

Figure 2:
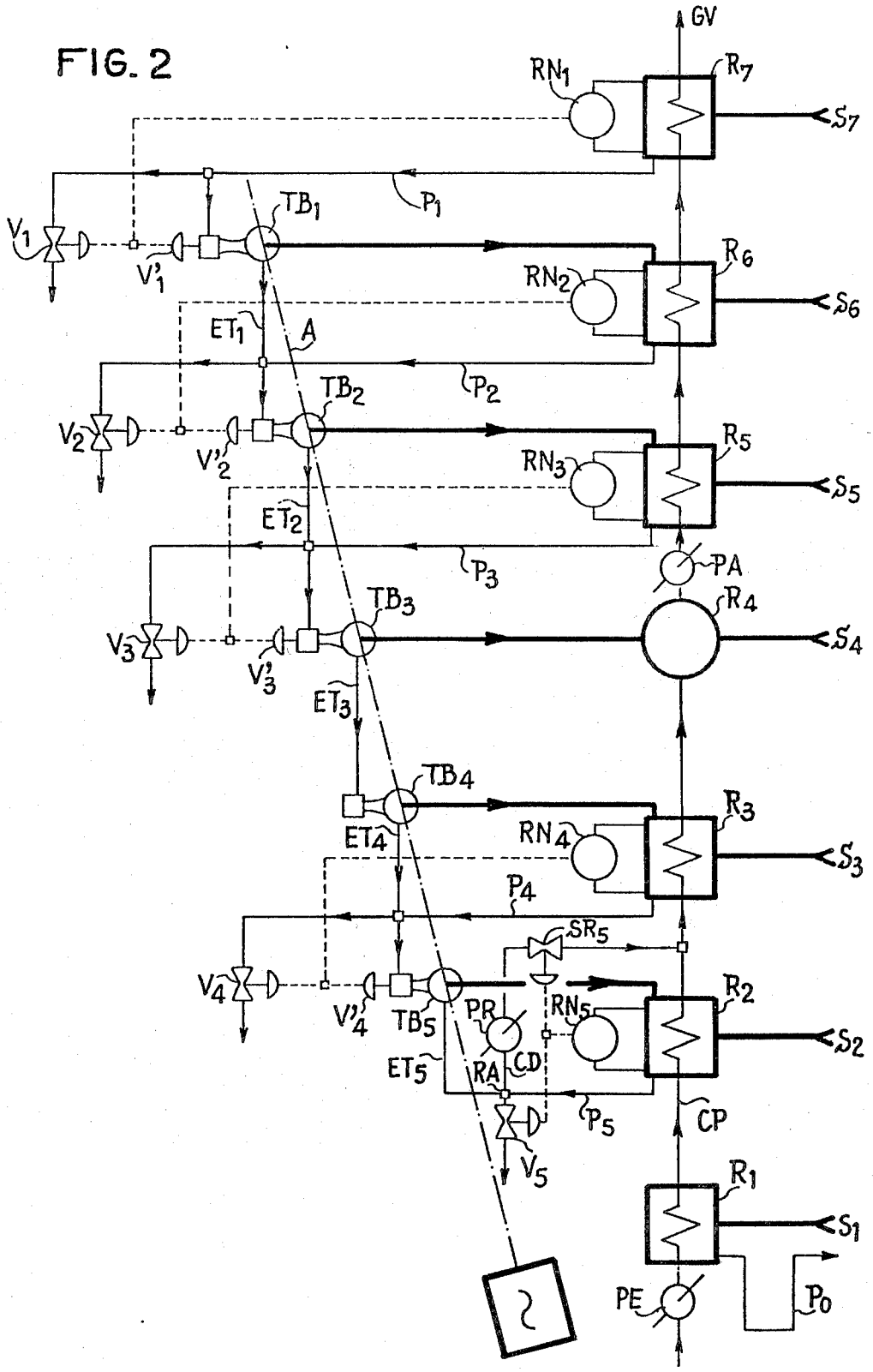
FIG. 2 is a diagram of a heating system according to the invention for an electric power station employing fossil fuel.

These drawbacks are avoided in the heating system according to the invention, the diagram of which is shown in FIG. 2, in which the same reference numerals as those employed in FIG. 1 are used for designating similar elements. Further, note that the flows, pressures and temperatures at different points of the circuit according to the invention are substantially the same as those indicated in FIG. 1 and will not be mentioned again.

The heating system according to the invention of FIG. 2 differs essentially from that of FIG. 1 in that the main regulating valves $SR_1$, $SR_2$, $SR_3$ and $SR_4$ and the phase separators $SP_1$, $SP_2$ and $SP_3$ have been dispensed with and replaced by biphase turbines. Thus the biphase turbine $TB_1$ replaces the regulating valve $SR_1$ and the phase separator $SP_1$, the biphase turbine $TB_2$ replaces the regulating valve $SR_2$ and the phase separator $SP_2$, the biphase turbine $TB_5$ replaces the regulating valve $SR_4$ and the phase separator $SP_3$ and an additional biphase turbine $TB_4$ is disposed between the biphase turbines $TB_3$ and $TB_5$.

The biphase turbines are of special design which are fed with a mixture of a liquid and a gas or vapour for driving a shaft in rotation, thereby producing mechanical work while ensuring a separation of the liquid and the gas, so that the latter may be collected separately at the outlet of the turbine. As this type of turbine is known in particular from the U.S. Pat. Nos. 3,879,949; 3,972,195 and 4,087,261 to which reference may be made, no detailed description will be given in the present description.

The condensates of the heater $R_7$ are introduced in the biphase turbines $TB_1$ in accordance with the level in this heater by adjustment of the position of the regulator $V'_1$ of the biphase turbine $TB_1$ controlled by the level regulator $RN_1$. These condensates are sent to the condenser by way of the safety regulating valve $V_1$ in the event that the biphase turbine $TB_1$ is not operating. The steam separated in the latter is sent to the steam zone of the heater $R_6$ whereas the separated water returns to the condensates of the heater $R_6$. This mixture is introduced in the following biphase turbine $TB_2$ as a function of the level in the heater $R_6$ by adjustment of its regulator $V'_2$ which is controlled by the level regulator $RN_2$. In the event that the biphase turbine $TB_2$ is not operating, the mixture is sent to the condenser by way of the safety regulating valve $V_2$. The steam separated in the biphase turbine $TB_2$ is sent to the steam zone of the heater $R_5$ whereas the separated water returns to the condensates of this heater. Again, this mixture is introduced in the following biphase turbine $TB_3$ as a function of the level in the heater $R_5$ by adjustment of its regulator $V'_3$ which is controlled by the level regulator $RN_3$. In the event that the biphase turbine $TB_3$ does not operate, the mixture is sent to the condenser by way of the safety regulating valve $V_3$. The steam separated in the biphase turbine $TB_3$ is sent to the mixing heater $R_4$ whereas the separated water is sent directly to the following biphase turbine $TB_4$. The steam separated in the latter is sent to the steam zone of the heater $R_3$ whereas the separated water joins the condensates in this heater. Lastly, this mixture is introduced in the last biphase turbine $TB_5$ as a function of the level in the heater $R_3$ by adjustment of its regulator $V'_4$ which is controlled by the level regulator $RN_4$. In the event of stoppage of the biphase turbine $TB_5$, the mixture is sent to the condenser through the safety regulating valve $V_4$. The steam separated in the biphase turbine $TB_5$ is sent to the steam zone of the heater $R_2$ whereas the separated water joins the condensates of this heater at RA. The part downstream of this system operates thereafter as the corresponding part of the conventional heating system of FIG. 1.

In operation, the power of the mixture of water and steam in each of the biphase turbines is received on a common shaft A for driving an auxiliary alternator, a pump or some other means. By way of a modification the biphase turbines may not be coupled to the same shaft so that each biphase turbine drives its own auxiliary device.

Figure 3:
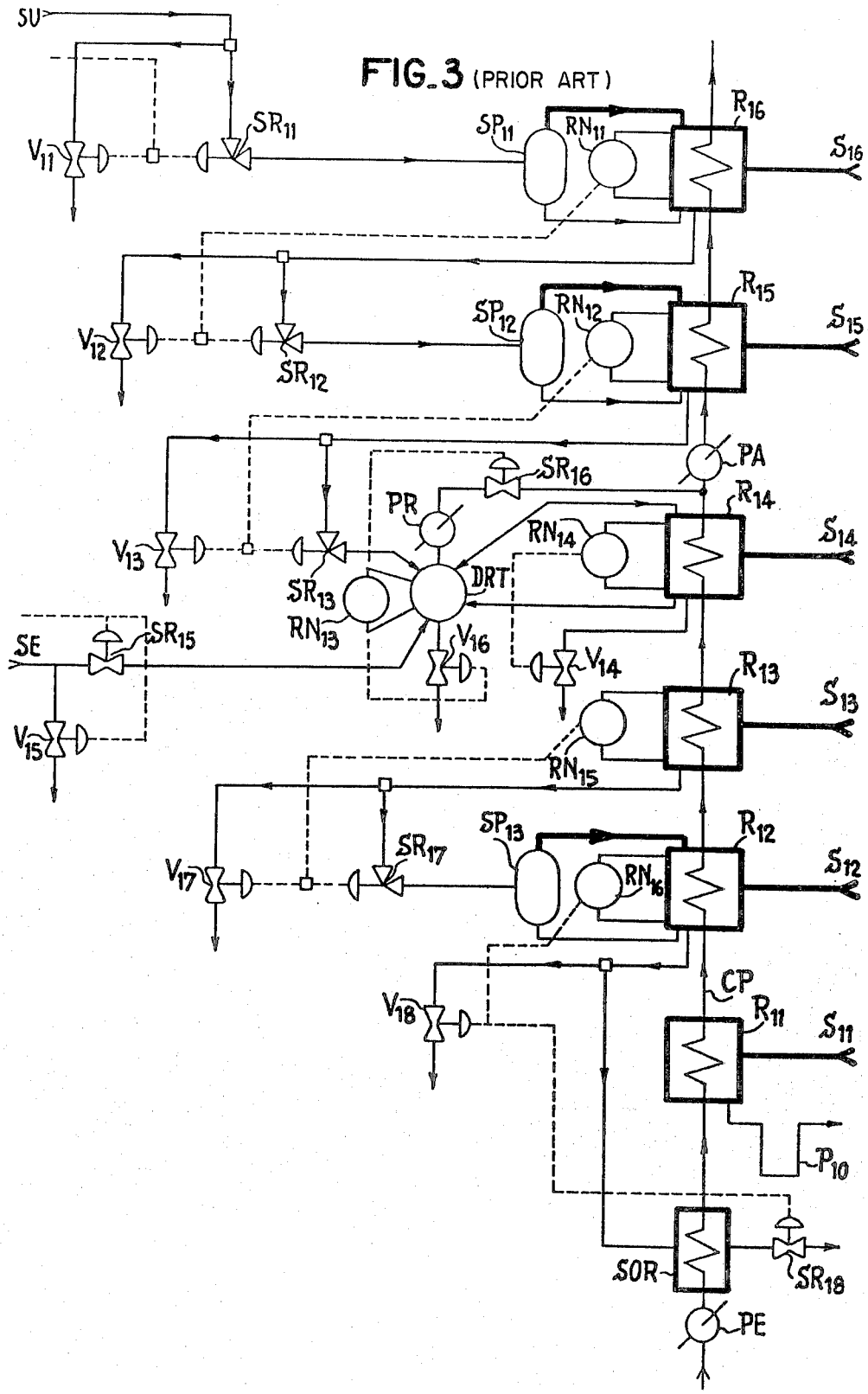
FIG. 3 (PRIOR ART)
FIG. 3 is a diagram of a conventional heating system for a nuclear electric power station.

Reference will now be made to FIG. 3 which shows a conventional heating system for a nuclear power station in which the same reference letters as those employed in FIGS. 1 and 2 are employed for designating like elements. As the heating system of FIG. 3 is conventional and is moreover in many ways similar to that of FIG. 1, it will be described more briefly than the system FIG. 1.

This heating system comprises, in the main circuit CP, a subcooler SOR and six heaters $R_{11}$ to $R_{16}$ fed with steam from drawoffs $S_{11}$ to $S_{16}$ respectively. The heater $R_{16}$ is also fed with the steam separated by a phase separator $SP_{11}$ from the condensates of a superheater SU (not shown). A main regulating valve $SR_{11}$ and a safety regulating valve $V_{11}$ which are controlled as a function of the level in the superheater enable the condensates of the latter to be sent to the phase separator $SP_{11}$ or to the following condenser as required, as described before. The following heater $R_{15}$ is fed with the steam separated from the condensates of the heater $R_{16}$ by a phase separator $SP_{12}$. A main regulating valve $SR_{12}$ and a safety regulating valve $V_{12}$ controlled by a level regulator $RN_{11}$ are provided.

The condensates of the heater $R_{15}$ are sent to a reservoir DRT for recovering the drains through a main regulating valve $SR_{13}$. In the case of an incident, a safety regulating valve $V_{13}$ enables these condensates to be sent directly to the condenser. The reservoir DRT also receives the condensates of a drier SE (not shown) through a main regulating valve $SR_{15}$. A safety regulating valve $V_{15}$ controlled in the same way as the valve $SR_{15}$ as a function of the level in the drier, enables these condensates to be sent directly to the condenser if necessary. The reservoir DRT receives the condensates of the heater $R_{14}$. A safety regulating valve $V_{14}$ controlled by the level regulator $R_{14}$ is provided for sending the condensates to the condenser if necessary.

The contents of the reservoir DRT are re-injected by way of a condensate withdrawing valve PR in the main circuit CP between the feed pump PA and the heater $R_{14}$, through a main regulating valve $SR_{16}$ which is controlled by a level regulator $RN_{13}$ associated with the reservoir DRT. This regulator $RN_{13}$ also controls a safety regulating valve $V_{17}$ whereby the condensates of the reservoir DRT may be sent to the condenser.

The condensates of the heater $R_{13}$ are sent, either to a phase separator $SP_{13}$ through a main regulating valve $SR_{17}$ or to the condenser through a safety regulating valve $V_{17}$ as a function of the control of the level regulator $RN_{15}$ of the heater $R_{13}$. The condensates of the heater $R_{12}$ are sent, either directly to the subheater SOR and from there to the condenser through a main regulation valve $SR_{18}$ or directly to the condenser through a safety regulating valve $V_{18}$ as a function of the control of the level regulator $RN_{16}$ of the heater $R_{12}$.

Figure 4:
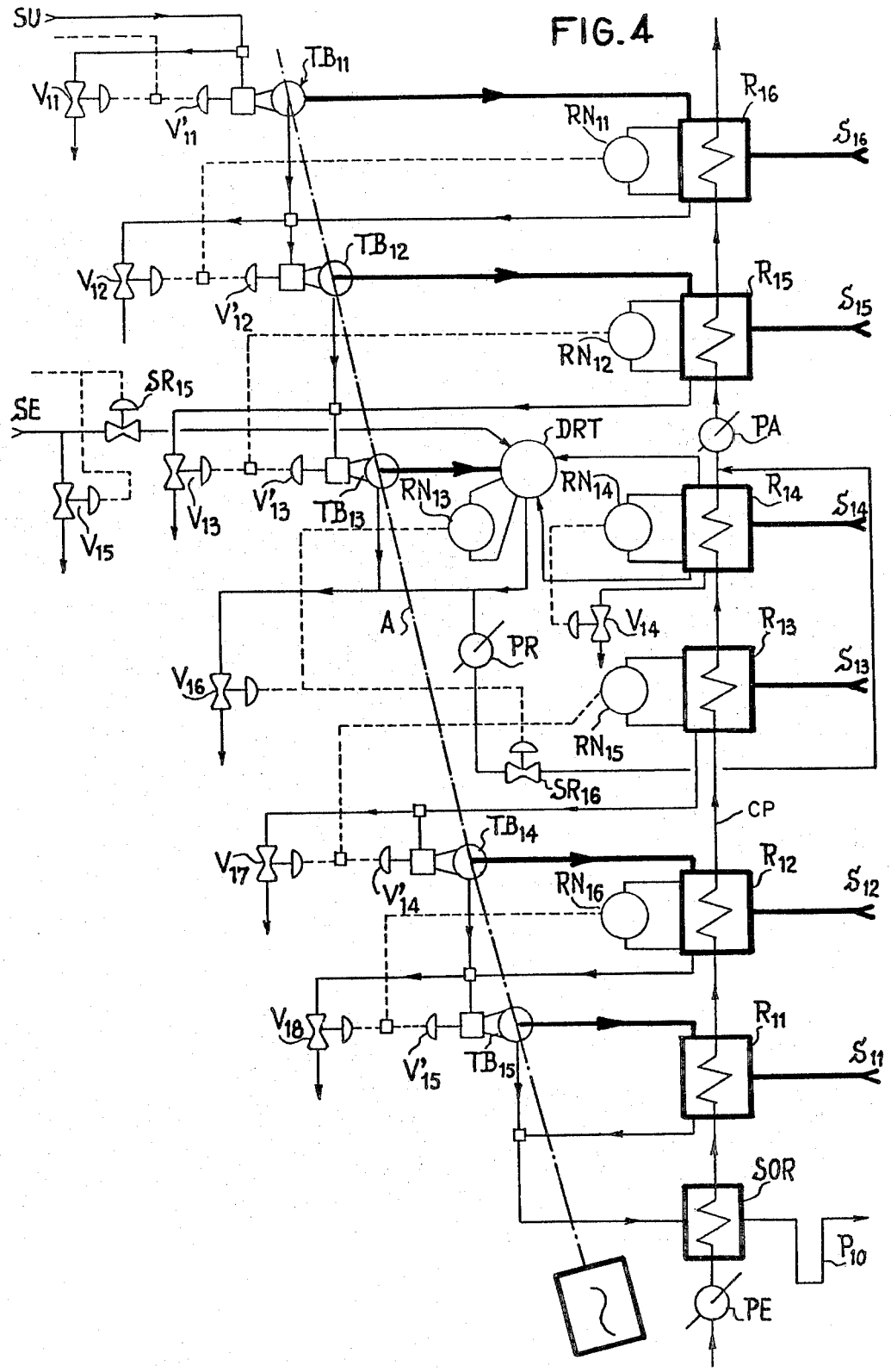
FIG. 4 is a diagram of a heating system according to the invention for a nuclear electric power station.

In the heating system according to the invention for a nuclear power station, as shown in FIG. 4, biphase turbines $TB_{11}$, $TB_{12}$, $TB_{13}$, $TB_{14}$ and $TB_{15}$ are respectively substituted for the main regulating valves $SR_{11}$, $SR_{12}$, $SR_{13}$ $SR_{17}$ and $SR_{18}$ and for the phase separators $SP_{11}$, $SP_{12}$ and $SP_{13}$ which are eliminated.

The steam separated by the turbines $TB_{11}$ and $TB_{12}$ is fed respectively to the heaters $R_{16}$ and $R_{15}$ whereas the water joins the respective condensates of these heaters so as to be fed to the following turbines $TB_{12}$ and $TB_{13}$ respectively. The steam separated by the biphase turbine $TB_{13}$ is sent to the reservoir DRT, whereas the water is sent upstream of the condensates-withdrawing pump PR so as to be re-injected with the drains of the reservoir DRT in the main circuit CP.

The biphase turbine $TB_{14}$ separates the steam from the condensates of the heater $R_{13}$ and sends the steam to the steam side of the heater $R_{13}$, whereas the water joins the condensates of this heater. This mixture is introduced in the biphase turbine $TB_{15}$ and the steam separated in the latter is sent to the steam zone of the heater $R_{11}$. The water joins the condensates of this heater and the mixture thus formed is sent to the sub-cooler SOR.

It will be understood that, as in the case of FIG. 2, the biphase turbines $TB_{11}$ to $TB_{15}$ are fed as a function of the level in the condensation exchanger from which they receive the condensates, by adjustment of the position of their respective regulator $V'_{11}$, $V'_{12}$, $V'_{13}$, $V'_{14}$ and $V'_{15}$. Likewise, also in this example, the power of the mixture of water and steam in each of the turbines is received on a common shaft A for driving auxiliary means or individually on the shaft of each turbine.

Thus, the heating system employing biphase turbines according to the invention both permits a cascade feeding of the heaters with the steam taken from the condensates of a preceding heater or from a superheater and provides additional mechanical power. Consequently, this improves the overall efficiency of the energy producing plant with which the heating system is associated.

Apart from this advantage in respect of efficiency, which may be expressed as an additional supply of power of 0.5 to 0.8%, the heating system according to the invention enables the static phase separators of the heating system of the prior art to be eliminated, since it is the biphase turbines themselves which effect the separation. As a result of just this fact, the aforementioned erosion phenomena separators are eliminated and the piping is simplified.

I claim:

1. A system for utilizing condensates of a steam turbine of an energy producing plant, comprising at least one condensation heat exchanger whose condensates are expanded toward a lower pressure exchanger, wherein said system comprises at least one biphase turbine disposed between said condensation heat exchanger and the lower pressure exchanger and fed with the condensates of said condensation heat exchanger.

2. A system as claimed in claim 1, comprising a series of condensation heat exchangers disposed in cascade and fed with steam from turbine drawoffs at pressures which progressively decrease from the steam boiler side to the condensor side of the power plant, the system comprising a plurality of biphase turbines disposed in cascade, the first turbine of said plurality being fed by the drain of the last of the series of said condensation heat exchangers at the highest pressure whereas the following turbines are each fed at least in part with the outlet liquid of the biphase turbine which precedes it.

3. A system as claimed in claim 2, wherein certain of said biphase turbines are fed both with the outlet liquid of other biphase turbines and with the condensates of the condensation heat exchangers which precede them on the upstream side.

4. A system as claimed in claim 3, comprising an intermediate mixing heater, wherein a biphase turbine associated with a condensation heat exchanger disposed immediately downstream of said mixing heater is fed solely with the outlet liquid of the biphase turbine feeding the said mixing heater.

5. A system as claimed in claim 2 or 3, comprising a super-heater upstream of the condensation heat exchanger operating at the highest pressure, wherein the system is provided with a biphase turbine between said super-heater and said condensation heat exchanger.

6. A system as claimed in claim 2, 3, or 4 comprising a biphase turbine associated with each of the plurality of consecutive condensation heat exchangers.

7. A system as claimed in claim 1, 2, 3, or 4 wherein the biphase turbines are coupled to a common power shaft.

8. A system as claimed in claim 1, 2, 3, or 4 wherein said biphase turbine includes a regulator regulating the feed thereto, each said regulator being controlled by a further regulator regulating the level of the condensates in said condensation exchanger.

* * * * *